US005698937A

United States Patent [19]

Ju et al.

[11] Patent Number: 5,698,937

[45] Date of Patent: Dec. 16, 1997

[54] CATHODE FOR ELECTRON TUBE

[75] Inventors: Gyu-nam Ju, Seoul; Jong-seo Choi, Anyang; Keun-bae Kim, Seoul; Kwang-min Lee, Suwon; Kwi-seok Choi, Seoul, all of Rep. of Korea

[73] Assignee: Samsung Display Devices Co., Ltd., Kyungki-do, Rep. of Korea

[21] Appl. No.: 393,534

[22] Filed: Feb. 23, 1995

[30] Foreign Application Priority Data

Oct. 12, 1994 [KR] Rep. of Korea ..... 94-26115

[51] Int. Cl.[6] ..... H01J 1/13

[52] U.S. Cl. ..... 313/346 R; 313/337; 313/270

[58] Field of Search ..... 313/346 R, 346 DC, 313/337, 270

[56] References Cited

U.S. PATENT DOCUMENTS

| | | | |
|---|---|---|---|
| 3,436,584 | 4/1969 | Hughes et al. | 313/346 R |
| 4,017,808 | 4/1977 | Fein et al. | 313/618 X |
| 4,073,989 | 2/1978 | Wainer | 313/103 CM X |
| 4,797,593 | 1/1989 | Sato et al. | 313/346 R |
| 5,030,879 | 7/1991 | Derks | 313/346 R |
| 5,066,885 | 11/1991 | Morimoto et al. | 313/340 |
| 5,146,131 | 9/1992 | Derks | 313/346 R |
| 5,348,934 | 9/1994 | Shaw | 313/346 R X |

FOREIGN PATENT DOCUMENTS

| | | | |
|---|---|---|---|
| 2060246 | 4/1981 | United Kingdom | 313/346 R |

*Primary Examiner*—Ashok Patel
*Attorney, Agent, or Firm*—Leydig, Voit & Mayer, Ltd.

[57] ABSTRACT

A cathode for an electron tube has a layer of electron-emissive substance containing alkaline earth metal carbonates having capillary crystals, to which 0.01–20.0 wt % of both a lanthanum (La) compound and a magnesium (Mg) compound or an La—Mg compound, based upon the weight of the alkaline earth metal carbonate, is added. The cathode enjoys full interchangeability with a conventional oxide cathode and a 15–20% longer lifetime.

8 Claims, 1 Drawing Sheet

CATHODE FOR ELECTRON TUBE

BACKGROUND OF THE INVENTION

The present invention relates to a cathode for an electron tube, more particularly, to a thermal electron emitting cathode having an enhanced lifetime for use in an electron tube such as a cathode ray tube or image pickup tube.

In a conventional thermal electron emitting cathode for an electron tube, an "oxide cathode" as it is called has come into wide use. An oxide cathode comprises a base metal including nickel (Ni) as a major component and a small amount of silicon (Si), magnesium (Mg) or the like as a reducing agent, and a waxing of an alkaline earth metal carbonate containing barium (Ba) as a major component, and preferably, a ternary carbonate composed of (Ba,Sr,Ca) $CO_3$ or a binary carbonate. Here, the term "oxide cathode" is derived from the fact that the carbonate is changed into oxide in an exhaust process of electron tube manufacturing.

FIG. 1 is a schematic sectional view illustrating a cathode for an electron tube, showing a disk-like base metal 2, a cylindrical tube-like sleeve 3 which is fitted to the lower part of base metal 2 for support and includes an internal heater 4 for heating the cathode, and a coating of an electron-emissive substance 1 containing Ba as a major component on the base metal. To obtain the cathode, an organic solvent such as nitrocellulose or the like is mixed with a powdered carbonate containing $BaCO_3$ as a principal component and then applied to base metal 2 by a process such as spraying or electro-deposition. Such a cathode is fitted on an electron gun and assembled inside an electron tube. Thereafter, the cathode is heated to 1000° C. by heater 4 in an exhaust process to create an internal vacuum, during which the barium carbonate converts to barium oxide as represented by the following expression.

$$BaCO_3 \rightarrow BaO + CO_2\uparrow \quad (1)$$

During cathode operation, the thus-produced barium oxide reacts with the reducing agent (the Si or Mg contained in the base metal) in the interface between the base metal and the layer of the electron-emissive substance, as represented by the following formulas.

$$BaO + Mg \rightarrow MgO + Ba\uparrow \quad (2)$$

$$4BaO + Si \rightarrow Ba_2SiO_4 + 2Ba\uparrow \quad (3)$$

The free Ba thus produced contributes to electron emission. Further, MgO, $Ba_2SiO_4$ or the like is formed in the interface between the layer of an electron-emissive substance and the base metal, and serves as a barrier called an "intermediate layer," to thereby prevent the Mg or Si from diffusing into the electron-emissive layer. Accordingly, the intermediate layer inhibits the generation of free Ba. Consequently, the intermediate layer results in a shortening of the life of a cathode. There is another disadvantage in that the high resistance of the intermediate layer prevents the flow of current for emitting electrons and limits current density.

Along with popular trends toward higher definition and larger screens for televisions and other devices using cathode-ray tubes, there has been an increasing need for cathodes having high current densities and longer lifetimes. However, conventional oxide cathodes are not capable of satisfying this need due to the aforementioned disadvantages with respect to performance and lifetime.

An impregnated cathode is known for its high current-density and long lifetime, but the manufacturing process therefor is complex and its operating temperature is over 1100° C., that is, about 300° C. or 400° C. higher than that of oxide cathodes. Accordingly, since the material of such a cathode must have a much higher melting point and is expensive to manufacture, its practical use is impeded.

Thus, a great deal of research has gone into lengthening the life of a conventional oxide cathode having a high degree of practicality. For example, U.S. Pat. No. 4,797,593 to Mitsubishi discloses a technique for improving the lifetime of a cathode by dispersing $Sc_2O_3$, $Y_2O_3$ or the like in a conventional ternary carbonate. Also, Japanese Patent Laid-open Publication Sho 64-41137 to Phillips discloses a technique in which $Eu_2O_3$ is contained in an electron emissive substance to improve cathode lifetime.

Here, the cathodes containing rare earth metals have enhanced lifetimes because the rare earth metal inhibits formation of an intermediate layer and evaporation of free Ba However, the electron emission of the cathode tends to drop off suddenly after a certain period of operation time because the rare earth metal accelerates sintering of oxides at the operating temperature of the cathode. Thus, oxide is charred to a hardened state, which results in a decrease in reaction sites with a reducing agent, reducing the quantity of emitted electrons. Moreover, the above-described cathodes do not have complete interchangeability with a conventional oxide cathode, and require modification of the cathode activation process for ensuring a steady and abundant emission of thermal electrons.

SUMMARY OF THE INVENTION

The object of the present invention is to provide a cathode for an electron tube in which lifetime is improved drastically and that has full interchangeability with the processes for manufacturing the conventional cathode.

The object of the present invention is achieved by a cathode for an electron tube comprising a base metal containing nickel (Ni) as a major component, and a layer of an electron-emissive substance formed on the base metal, the layer comprising an alkaline earth metal oxide converted from an alkaline earth metal carbonate containing barium (Ba) as a major component by heat treatment and both a lanthanum (La) compound and a magnesium (Mg) compound or a lanthanum-magnesium compound.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

The magnesium contained in the layer of electron-emissive substance according to the present invention inhibits the rare earth metal from accelerating cathode sintering. Therefore, by including a rare earth metal and magnesium in the layer of electron-emissive substance, oxide sintering is inhibited, so that a uniform quantity of electrons can be emitted for a long time, thereby improving the lifetime of the cathode.

Further, the La compound and Mg compound are also mixed with a carbonate and then nitrocellulose or the like are added to the mixture thus obtained, so that a suspension is prepared. This suspension is applied to the base metal by means of spraying, electro-deposition or the like. Accordingly, the process for manufacturing the cathode of the present invention has full interchangeability with conventional processes and can be easily put to practical use.

Figure 1:
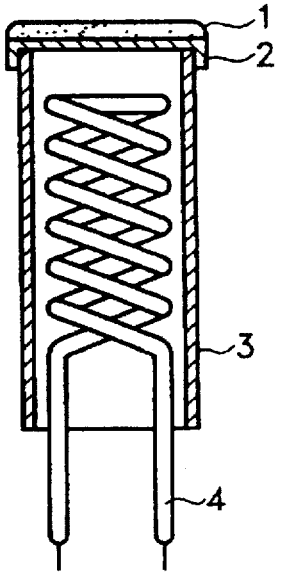
FIG. 1 is a schematic sectional view of a general cathode for an electron tube.

FIG. 1 is a sectional view of a general cathode for an electron tube as described above. The cathode according to the present invention has an electron-emissive substance layer on the base metal 2, in the form of $(Ba,Sr,Ca)CO_3$ containing both an La compound and an Mg compound or a La—Mg compound. Particularly, it is preferable to use both lanhanum nitrate and magnesium nitrate as the La compound and the Mg compound, respectively, and to use an La—Mg nitrate previously formed from lanthanum nitrate and magnesium nitrate as the La—Mg compound because nitrate is easily becomes colloidal in butanol or nitrocellulose and is thus dispersed uniformly into the carbonates.

Generally, nitrates such as $Ba(NO_3)_2$, $Sr(NO_3)_2$ and $Ca(NO_3)_2$ are dissolved in pure water and then coprecipitated from the solution by using $Na_2CO_3$ or $(NH_4)_2CO_3$ as a precipitator to obtain a coprecipitate ternary carbonate, wherein various forms of carbonate crystal particles are produced, according to the nitrate concentration or pH value, the temperature during precipitation, and the rate of precipitation. In manufacturing the cathode of the present invention, a carbonate having a capillary crystal structure (known as a preferred structure) can be obtained by controlling these conditions.

Figure 2:
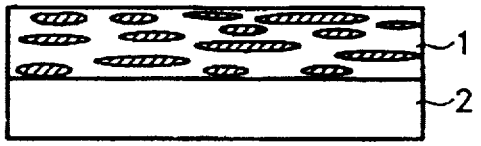
FIG. 2 is an enlarged view illustrating a typical layer of an electron-emissive substance of a conventional cathode for an electron tube, showing a ternary carbonate having a capillary crystalline structure.

FIG. 2 is an enlarged view of a typical layer of an electron-emissive substance of a conventional cathode for an electron tube, showing a ternary carbonate having a capillary crystalline structure.

In manufacturing the cathode of the present invention, an La compound and an Mg compound, or an La—Mg compound added to a coprecipitate carbonate of an alkaline earth metal having a capillary crystal structure is preferred to be 0.01 wt % to 20.0 wt % based upon the weight of the alkaline earth metal carbonate. Here, if the amount is less than 0.01 wt %, the lifetime enhancing effect is slight, and if more than 20.0 wt %, the initial emission characteristic is poor.

When both an La compound and an Mg compound, are present it is preferred to use these in the same weight. when an La—Mg compound is present, it is preferred to use the La—Mg nitrate obtained by mixing lanthanum nitrate and magnesium-nitrate.

Hereinbelow, the present invention is described more concretely with respect to specific examples intended to illustrate the instant invention without limiting the scope thereof.

EXAMPLE 1

Nitrates such as $Ba(NO_3)_2$, $Sr(NO_3)_2$, $Ca(NO_3)_2$ were dissolved in pure water and coprecipitated by using $Na_2CO_3$, to obtain a coprecipitate ternary carbonate. Thereafter, 1.5 wt % of $La(NO_3)_3 \cdot 6H_2O$ and $Mg(NO_3)_2 \cdot 6H_2O$, respectively, based upon the weight of the ternary carbonate was added to the carbonate. The thus-obtained mixture was applied to the base metal. The cathode thus formed was inserted and fitted within an electron gun, followed by inserting and fitting a heater for heating the cathode within a sleeve. The electron gun was sealed in the bulb of an electron tube that was evacuated to create an internal vacuum, whereby the heater decomposed the carbonate of the electron-emissive substance layer to form an oxide. In this way, the cathode according to the present invention was prepared. Thereafter, an electron tube was produced by a conventional manufacturing process and its initial emission was estimated. The initial emission characteristic was estimated using current (called "MIK(maximum cathode current)" and the lifetime of the cathode was determined by a residual rate over a given period in relation to the initial MIK value (see FIG. 3).

EXAMPLE 2

An La—Mg compound prepared by a separate manufacturing process was added to a ternary carbonate obtained in the same manner as Example 1. In other words, lanthanum nitrate and magnesium nitrate were mixed uniformly to obtain an La—Mg nitrate $Mg_3La_2(NO_3)_{12} \cdot 24H_2O$. Then, 1.4 wt % of the La—Mg compound, based upon the weight of the ternary carbonate, was added to the carbonate, followed by the same process as Example 1, to produce the cathode according to the present invention and estimate the initial emission characteristic and lifetime of the cathode (see FIG. 3).

COMPARATIVE EXAMPLE

A conventional cathode was prepared in the same manner as Example 1 but without adding $La(NO_3)_3 \cdot 6H_2O$ and $Mg(NO_3)_2 \cdot 6H_2O$. The initial emission characteristic and the lifetime of the cathode was estimated (see FIG. 3).

Figure 3:
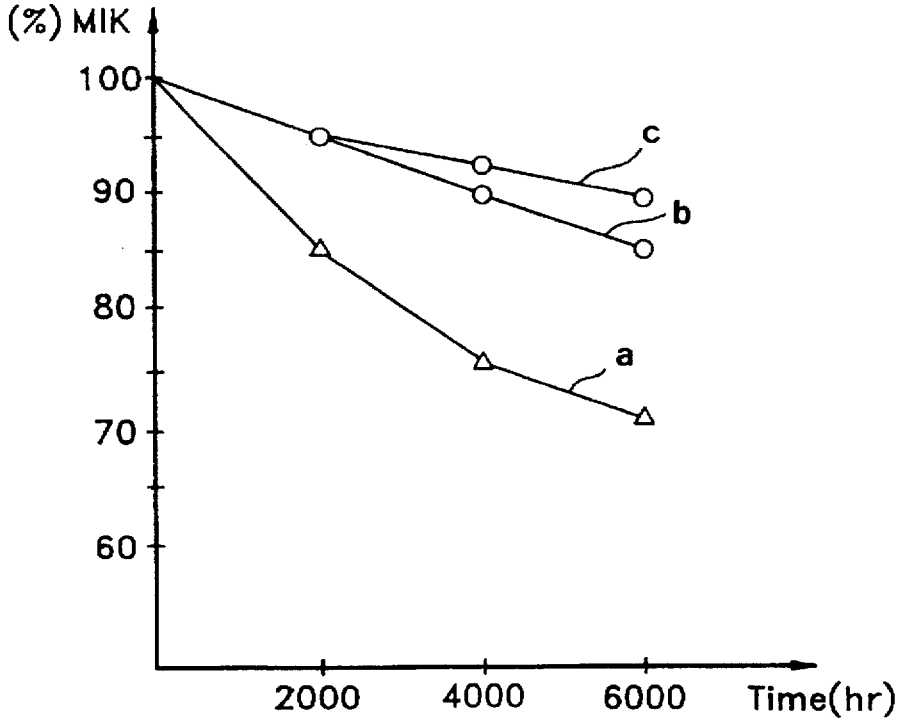
FIG. 3 is a graph comparing lifetime characteristics of cathodes for electron tubes according to the present invention with a conventional cathode.

FIG. 3 illustrates lifetime characteristics of a conventional cathode and cathodes including the new material of the present invention. Here, the "a" curve illustrates the lifetime characteristics of a cathode having a layer of an electron-emissive substance containing a conventional ternary carbonate, the "b" curve corresponds to a cathode in which the layer contains a conventional ternary carbonate and La and Mg compounds, and the "c" curve corresponds to a cathode in which the layer contains a conventional ternary carbonate and an La—Mg compound. As indicated by FIG. 3, the lifetime of the cathode according to the present invention was 15–20% longer than that of the conventional cathode.

As shown in the above examples and the comparative example, the cathode of the present invention is a new oxide cathode, not only having a 15–20% longer lifetime than a conventional cathode under equal conditions, but also enjoying full interchangeability with the processes for manufacturing the conventional oxide cathode. Accordingly, the cathode of the present invention overcomes the disadvantages of a short life which hinders use in large-screen high-definition tubes, while still being capable of incorporation into mass-production processes.

What is claimed is:

1. A cathode for an electron tube including:

a base metal; and a layer of an electron-emissive substance disposed on said base metal, said layer comprising an alkaline earth metal oxide produced by heat treatment of an alkaline earth metal carbonate containing barium as a major component, a lanthanum compound, and a magnesium compound.

2. The cathode for an electron tube in accordance with claim 1 including 0.01–20.0 wt % of said lanthanum compound and of said magnesium compound, based on the weight of said alkaline earth metal carbonate.

3. The cathode for an electron tube in accordance with claim 1 wherein said lanthanum compound is lanthanum nitrate and said magnesium compound is magnesium nitrate.

4. The cathode for an electron tube in accordance with claim 1 including a filament disposed proximate said base metal for heating the electron-emissive substance.

5. A cathode for an electron tube including;

a base metal; and a layer of an electron-emissive substance disposed on said base metal, said layer comprising an alkaline earth metal oxide produced by heat treatment of an alkaline earth metal carbonate containing barium as a major component and a lanthanum-magnesium compound.

6. The cathode for an electron tube in accordance with claim 5 including 0.01–20.0 wt % of said lanthanum-magnesium compound, based on the weight of said alkaline earth metal carbonate.

7. The cathode for an electron tube in accordance with claim 5 wherein the lanthanum-magnesium compound is lanthanum-magnesium nitrate.

8. The cathode for an electron tube in accordance with claim 5 including a filament disposed proximate said base metal for heating the electron-emissive substance.

* * * * *